US009997288B2

(12) United States Patent
Yamaguchi et al.

(10) Patent No.: US 9,997,288 B2
(45) Date of Patent: Jun. 12, 2018

(54) ELECTRONIC COMPONENT

(71) Applicant: MURATA MANUFACTURING CO., LTD., Kyoto-fu (JP)

(72) Inventors: Koichi Yamaguchi, Kyoto-fu (JP); Masaki Kitajima, Kyoto-fu (JP); Akinori Hamada, Kyoto-fu (JP)

(73) Assignee: MURATA MANUFACTURING CO., LTD., Kyoto-fu (JP)

( * ) Notice: Subject to any disclaimer, the term of this patent is extended or adjusted under 35 U.S.C. 154(b) by 206 days.

(21) Appl. No.: 14/872,980

(22) Filed: Oct. 1, 2015

(65) Prior Publication Data

US 2016/0099098 A1 Apr. 7, 2016

(30) Foreign Application Priority Data

Oct. 1, 2014 (JP) ..... 2014-203140

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 17/04*** | (2006.01) |
| ***H01F 27/29*** | (2006.01) |

(52) U.S. Cl.

CPC ..... *H01F 17/0006* (2013.01); *H01F 17/04* (2013.01); *H01F 27/292* (2013.01)

(58) Field of Classification Search

USPC ..... 336/200

See application file for complete search history.

(56) References Cited

U.S. PATENT DOCUMENTS 7,859,377 B2 * 12/2010 Kawarai ..... H01F 17/0006 336/83
2012/0105188 A1 * 5/2012 Lim ..... H01F 17/0033 336/200

FOREIGN PATENT DOCUMENTS

| | | |
|---|---|---|
| JP | S61-248507 A | 11/1986 |
| JP | 2009-009985 A | 1/2009 |
| JP | 5054445 B | 10/2012 |

(Continued)

OTHER PUBLICATIONS

An Office Action; "Notice of Reasons for Rejection," issued by the Japanese Patent Office dated Feb. 28, 2017, which corresponds to Japanese Patent Application No. 2014-203140 and is related to U.S. Appl. No. 14/872,980; with English language translation.

(Continued)

*Primary Examiner* — Ronald Hinson
(74) *Attorney, Agent, or Firm* — Studebaker & Brackett PC

(57) ABSTRACT

An electronic component includes a body and a coil. The body includes first to fourth insulator layers composed of an anisotropic magnetic material, an internal magnetic circuit composed of an isotropic magnetic material and an external magnetic circuit composed of an isotropic magnetic material. The second and third insulator layers cover an upper surface and a lower surface of the coil from a z-axis direction. The internal magnetic circuit and the external magnetic circuit are adjacent to each other in a direction orthogonal to the z-axis direction. In addition, a direction of easy magnetization of the anisotropic magnetic material used in the first to fourth insulator layers is orthogonal to the z-axis direction.

5 Claims, 9 Drawing Sheets

(56) References Cited

FOREIGN PATENT DOCUMENTS

| | | | |
|---|---|---|---|
| JP | 2015-159144 | A | 9/2015 |
| WO | 2013/183452 | A1 | 12/2013 |

OTHER PUBLICATIONS

An Office Action; "Decision of Refusal," issued by the Japanese Patent Office dated Dec. 12, 2017, which corresponds to Japanese Patent Application No. 2014-203140 and is related to U.S. Appl. No. 14/872,980.

* cited by examiner

ELECTRONIC COMPONENT

CROSS REFERENCE TO RELATED APPLICATIONS

This application claims benefit of priority to Japanese Patent Application No. 2014-203140 filed Oct. 1, 2014, the entire content of which is incorporated herein by reference.

BACKGROUND

1. Technical Field

The present disclosure relates to an electronic component and in particular relates to an electronic component employing an isotropic magnetic material and an anisotropic magnetic material and having a built-in coil.

2. Description of the Related Art

The coil component described in Japanese Patent No. 5054445 is an example of a known electronic component employing an isotropic magnetic material and an anisotropic magnetic material and having a built-in coil. In an electronic component 510 of this type (electronic component of the related art), sheets 520, which are composed of an anisotropic magnetic material, are stacked on an upper surface and a lower surface of a coil 512, as illustrated in FIG. 21. In addition, a direction of easy magnetization of the sheets 520 composed of the anisotropic magnetic material is orthogonal to a central axis L500 of the coil 512. A region on the inner peripheral side of the coil 512 is filled with an isotropic magnetic material 535 and a region on the outer peripheral side of the coil 512 is also filled with the isotropic magnetic material 535.

Magnetic flux generated by the coil 512 draws a loop that advances along an outer peripheral side surface of the coil, a lower surface of the coil, an inner peripheral side surface of the coil and an upper surface of the coil in this order and then returns to the outer peripheral side surface of the coil. Here, in the electronic component 510, the direction of magnetic flux generated by the coil 512 changes to a direction of hard magnetization from the direction of easy magnetization inside the sheets 520. For example, as illustrated in FIG. 21, in a region A500 in the vicinity of a boundary of the sheet 520 with the isotropic magnetic material 535, the direction of the magnetic flux changes from a direction orthogonal to the central axis L500, which coincides with the direction of easy magnetization, to a direction parallel to the central axis L500, which coincides with the direction of hard magnetization. Therefore, it is difficult to obtain a high effective magnetic permeability in the electronic component 510.

SUMMARY

An object of the present disclosure is to provide an electronic component that employs an isotropic magnetic material and an anisotropic magnetic material and has a built-in coil, and is able to obtain a high effective magnetic permeability.

An electronic component according to a preferred embodiment of the present disclosure includes a body composed of an insulator including an anisotropic magnetic material and an isotropic magnetic material; and a coil located inside the body. The anisotropic magnetic material is provided so as to cover an end surface, the end surface being a surface of an end portion of the coil in a central axis direction, which is parallel to a central axis of the coil, and being a surface of a conductor portion of the coil. The isotropic magnetic material is adjacent to the anisotropic magnetic material in an orthogonal direction, which is orthogonal to the central axis direction. A direction of easy magnetization of a portion of the anisotropic magnetic material that covers the end surface in a vicinity of an interface between the anisotropic magnetic material and the isotropic magnetic material coincides with the orthogonal direction.

In the electronic component according to the preferred embodiment of the present disclosure, the anisotropic magnetic material and the isotropic magnetic material are adjacent to each other in the orthogonal direction, which is orthogonal to the central axis of the coil. In addition, the direction of easy magnetization of the anisotropic magnetic material is parallel to the orthogonal direction, which is orthogonal to the central axis of the coil. Thus, magnetic flux generated by the coil of the electronic component according to the preferred embodiment of the present disclosure is directed toward the isotropic magnetic material without there being a large change in the direction of the magnetic flux from the direction of easy magnetization to the direction of hard magnetization inside the anisotropic magnetic material. As a result, in the electronic component according to the preferred embodiment of the present disclosure, a higher effective magnetic permeability can be obtained than in the electronic component of the related art.

According to the preferred embodiment of the present disclosure, a high effective magnetic permeability can be obtained in an electronic component employing an isotropic magnetic material and an anisotropic magnetic material and having a built in coil.

Other features, elements, characteristics and advantages of the present disclosure will become more apparent from the following detailed description of preferred embodiments of the present disclosure with reference to the attached drawings.

DETAILED DESCRIPTION

Configuration of Electronic Component

Figure 1:
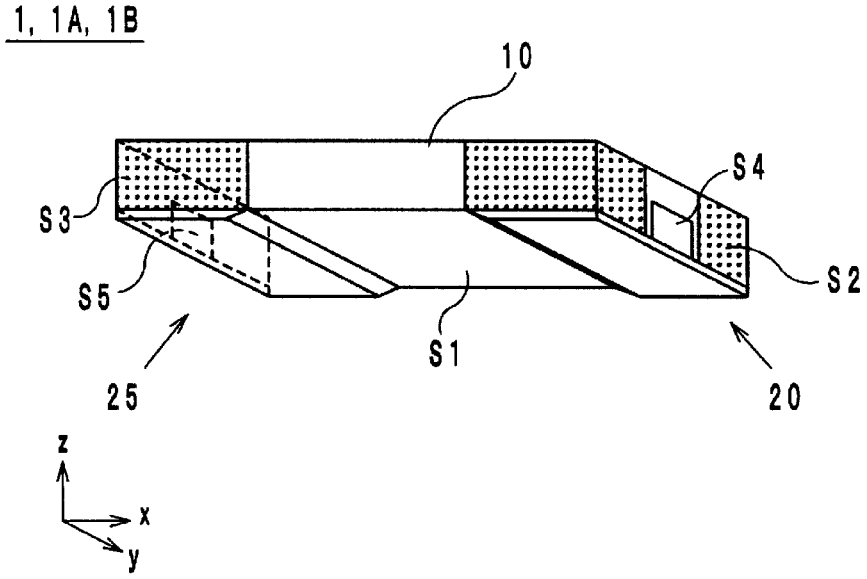
FIG. 1 is a view of the exterior of an electronic component of an embodiment.

The configuration of an electronic component 1 of an embodiment will be described while referring to FIGS. 1 to 3. Hereafter, a direction parallel to a central axis of a coil included in the electronic component 1 is defined as a z-axis direction. In addition, when looking in plan view from the z-axis direction, a direction along long edges of the electronic component 1 is defined as an x-axis direction and a direction along short edges of the electronic component 1 is defined as a y-axis direction. In addition, a surface that is located on the positive side in the z-axis direction is referred to as an upper surface and a surface that is located on the negative side in the z-axis direction is referred to as a lower surface. The x axis, the y axis and the z axis are orthogonal to one another.

The electronic component 1 includes a body 10 and outer electrodes 20 and 25. In addition, a coil 30 and via conductors and 38 are built into the electronic component 1 and the electronic component 1 is substantially rectangular parallelepiped shaped as illustrated in FIG. 1.

Figure 2:
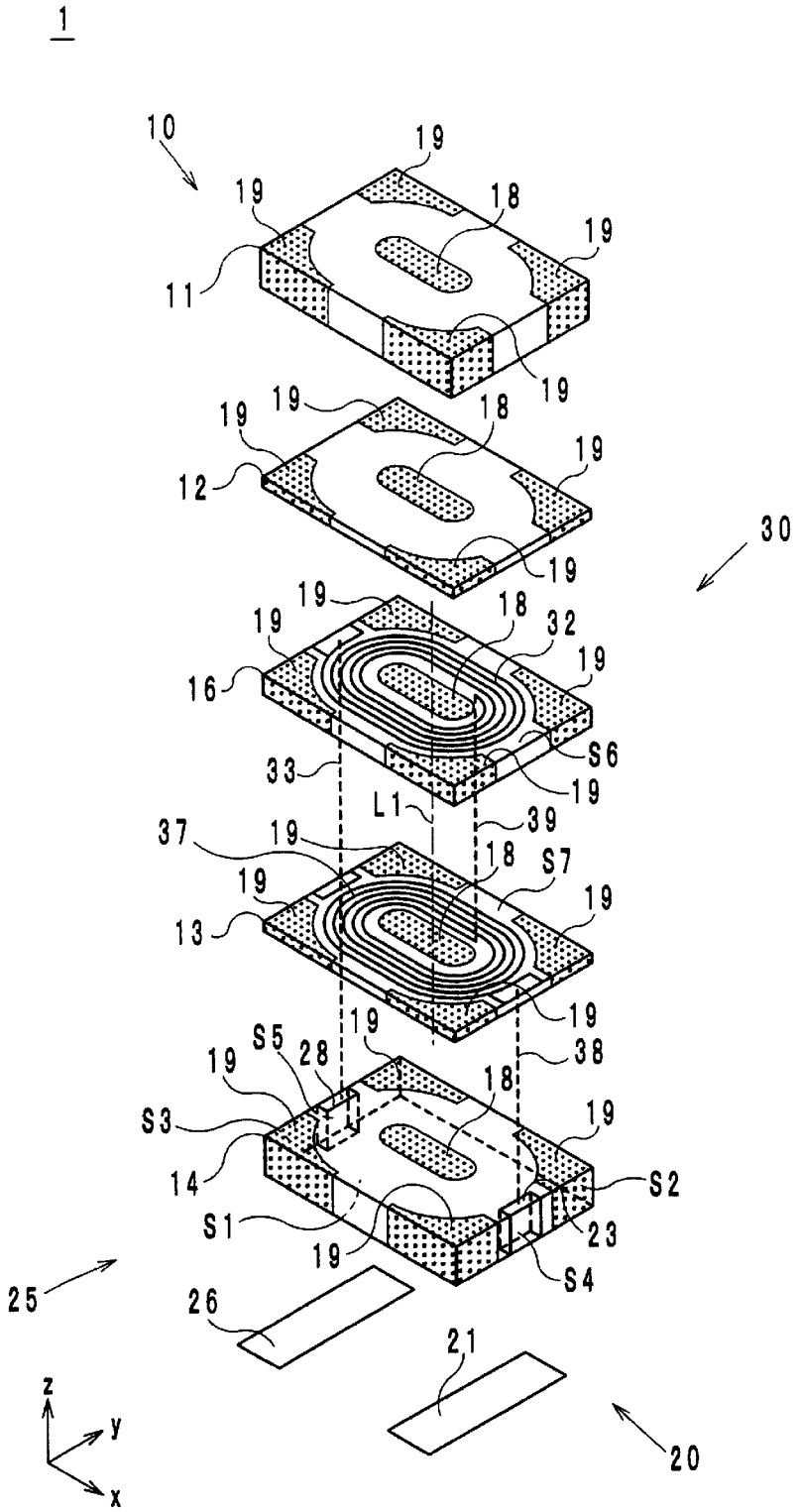
FIG. 2 is an exploded perspective view of the electronic component of the embodiment.
Figure 3:
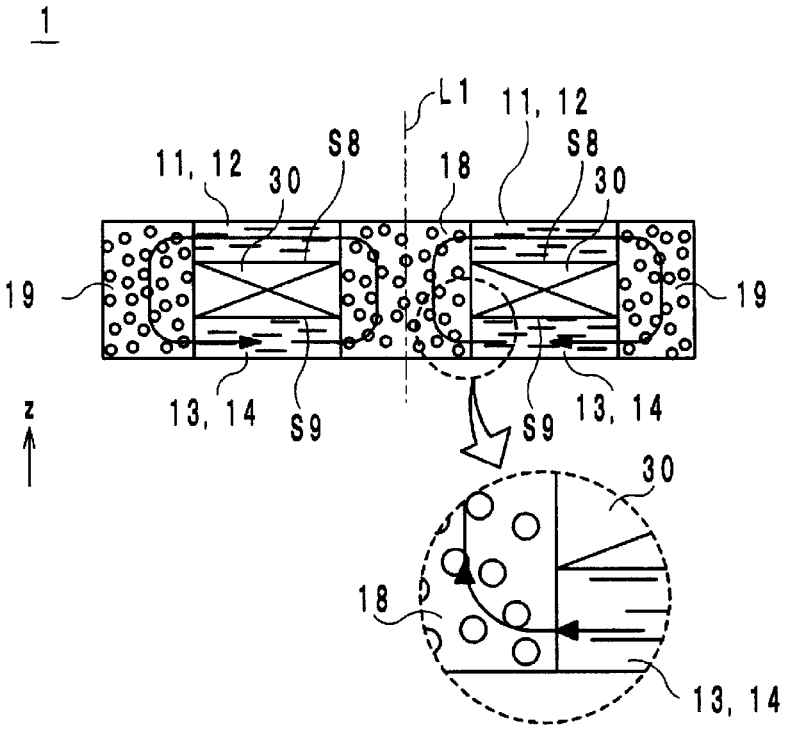
FIG. 3 is a sectional view of the electronic component of the embodiment.

As illustrated in FIG. 2, the body 10 includes insulator layers 11 to 14, an insulator substrate 16, an internal magnetic circuit 18 and an external magnetic circuit 19. In addition, the insulator layers 11 and 12, the insulator substrate 16, and the insulator layers 13 and 14 are stacked in this order from the positive side to the negative side in the z-axis direction in the body 10.

The insulator layers 11 to 14 are layers composed of a anisotropic magnetic material. Specifically, the insulator layers 11 to 14 are composed of a composite magnetic material in which a soft magnetic metal powder is dispersed in a resin material and have a thickness on the order of around several tens of μm to several hundred μm. Here, particles of the soft magnetic metal powder contained in the insulator layers 11 to 14 are molded into a flat or needle-like shape using for example normal temperature pressing in the manufacturing process and are shaped so as to extend in a direction orthogonal to the z-axis direction. Thus, the direction of easy magnetization in the insulator layers 11 to 14 is orthogonal to the z axis. Examples of the soft magnetic metal powder used in the insulator layers 11 to 14 include a powder containing iron, an iron-nickel alloy, an iron-cobalt alloy or an iron-aluminum-silicon alloy, or an iron-based amorphous metal or a cobalt-based amorphous metal.

The insulator substrate 16 is a printed circuit board formed by impregnating a glass fiber cloth with an epoxy resin and is sandwiched between the insulator layer 12 and the insulator layer 13 in the z-axis direction. The material of the insulator substrate 16 may be an insulating resin such as benzocyclobutene or an insulating inorganic material such as a glass ceramic.

The internal magnetic circuit 18 is located on the inner peripheral side of coil conductors 32 and 37, which will be described later, when viewed from the z-axis direction and has a substantially pillar-like shape that penetrates through the insulator layers 11 to 14 and the insulator substrate 16 in the z-axis direction. In addition, the internal magnetic circuit 18 has a substantially oval cross section. Furthermore, the internal magnetic circuit 18 is composed of an isotropic magnetic material. The isotropic magnetic material forming the internal magnetic circuit 18 and the anisotropic magnetic material forming the insulator layers 11 to 14 are the same except that the shape of the particles of the soft magnetic metal powder contained in the isotropic magnetic material forming the internal magnetic circuit 18 is substantially spherical.

Constituent portions of external magnetic circuit 19 have a substantially pillar-like shape that penetrates through the insulator layers 11 to 14 and the insulator substrate 16 in the z-axis direction when viewed from the z-axis direction and are provided at the four corners of each of the insulator layers so as to follow the outer periphery of the coil conductors 32 and 37, which will be described later. In addition, the external magnetic circuit 19 is formed of the same isotropic magnetic material as the internal magnetic circuit 18.

The outer electrode 20 is provided on a bottom surface S1 and a side surface S2 of the body 10 on the positive direction side in the x-axis direction when viewing the exterior of the body 10. In addition, the outer electrode 20 is formed of a bottom surface electrode 21 composed of a metal-resin composite material and a pillar-shaped electrode 23 composed of Cu. Examples of other materials that can be used for the pillar-shaped electrode 23 include Au, Ag, Pd and Ni.

The bottom surface electrode 21 is a so-called resin electrode in which a low-resistance metal powder, in this embodiment, Ag-coated Cu powder with an average particle diameter of around 100 nm, is dispersed in a phenol-based resin. In addition, the bottom surface electrode 21 is a flat-plate-shaped electrode provided in a region of the bottom surface S1 of the insulator layer 14 on the positive side in the x-axis direction. The bottom surface electrode 21 has a substantially rectangular shape when viewed in plan from the negative side in the z-axis direction.

The pillar-shaped electrode 23 is provided in a region inside the body 10 on the positive side in the x-axis direction and extends so as to penetrate through the insulator layer 14 in the z-axis direction. A side surface S4 of the pillar-shaped electrode 23 on the positive side in the x-axis direction is exposed at the side surface S2 of the body 10. In addition, the pillar-shaped electrode 23 is substantially rectangular parallelepiped shaped.

The outer electrode 25 is provided on the bottom surface S1 and a side surface S3 of the body 10 on the negative direction side in the x-axis direction when viewing the exterior of the body 10. In addition, the outer electrode 25 is formed of a bottom surface electrode 26 composed of a metal-resin composite material and a pillar-shaped electrode 28 composed of Cu or the like. Examples of other materials that can be used for the pillar-shaped electrode 28 include Au, Ag, Pd and Ni.

The bottom surface electrode 26 is a so-called resin electrode in which a low-resistance metal powder, in this embodiment, Ag-coated Cu powder with an average particle diameter of around 100 nm, is dispersed in a phenol-based resin. In addition, the bottom surface electrode 26 is a flat-plate-shaped electrode provided in a region of the bottom surface S1 of the insulator layer 14 on the negative side in the x-axis direction. The bottom surface electrode 26 has a substantially rectangular shape when viewed in plan from the negative side in the z-axis direction.

The pillar-shaped electrode 28 is provided in a region inside the body 10 on the negative side in the x-axis direction and extends so as to penetrate through the insulator layer 14 in the z-axis direction. A side surface S5 of the pillar-shaped electrode 28 on the negative side in the x-axis direction is exposed at the side surface S3 of the body 10. In addition, the pillar-shaped electrode 28 is substantially rectangular parallelepiped shaped.

The coil 30 is located inside the body 10 and is composed of a conductive material such as Au, Ag, Cu, Pd or Ni. In addition, the coil 30 is formed of the coil conductor 32, the coil conductor 37 and a via conductor 39. The coil 30 and the outer electrodes 20 and 25 are connected to each other by the via conductors 33 and 38.

As illustrated in FIG. 2, the coil conductor 32 is provided on an upper surface S6 of the insulator substrate 16. In addition, the coil conductor 32 is formed of a plurality of straight portions and a plurality of arc-shaped portions and is a spiral line-shaped conductor that becomes more distant from the center while looping clockwise when viewed in plan from the positive side in the z-axis direction. An end of the coil conductor 32 on the outer peripheral side extends to an outer edge of the insulator substrate 16 on the negative side in the x-axis direction.

The via conductor 33 connects the end of the coil conductor 32 on the outer peripheral side and the pillar-shaped electrode 28 to each other. Therefore, the via conductor 33 penetrates through the insulator substrate 16 and the insulator layer 13 in the z-axis direction.

The coil conductor 37 is provided on the lower surface of the insulator substrate 16, that is, is provided on an upper surface S7 of the insulator layer 13. In addition, the coil conductor 37 is formed of a plurality of straight portions and a plurality of arc-shaped portions and is a spiral line-shaped conductor that becomes closer to the center while looping clockwise when viewed in plan from the positive side in the z-axis direction. An end of the coil conductor 37 on the outer peripheral side extends to an outer edge of the insulator layer 13 on the positive side in the x-axis direction.

The via conductor 38 connects the end of the coil conductor 37 on the outer peripheral side and the pillar-shaped electrode 23 to each other. Therefore, the via conductor 38 penetrates through the insulator layer 13 in the z-axis direction.

The via conductor 39 penetrates through the insulator substrate 16 in the z-axis direction and connects the other end of the coil conductor 32 on the inner peripheral side and the other end of the coil conductor 37 on the inner peripheral side to each other.

A signal input from the outer electrode 20 or the outer electrode 25 is output from the outer electrode 25 or the outer electrode 20 via the coil 30 and in this way the thus-structured electronic component 1 functions as an inductor. In addition, as illustrated in FIG. 3, an upper surface of the coil 30, that is, an upper surface S8 of the coil conductor 32 is covered by the insulator layer 12 formed of the anisotropic magnetic material. Furthermore, a lower surface of the coil 30, that is, a lower surface S9 of the coil conductor 37 is covered by the insulator layer 13 formed of the anisotropic magnetic material. These anisotropic magnetic material portions are adjacent to the internal magnetic circuit 18, which is composed of the isotropic magnetic material provided on the inner peripheral side of the coil conductors 32 and 37, and the external magnetic circuit 19, which is composed of the isotropic magnetic material provided on the outer peripheral side of the coil conductors 32 and 37, in a direction orthogonal to the z-axis direction.

Manufacturing Method

Hereafter, a manufacturing method for the electronic component 1 of the embodiment will be described with reference to FIGS. 4 to 17. The z-axis direction used when describing the manufacturing method is a direction that is parallel to a central axis of the coil of the electronic component 1 manufactured using the manufacturing method.

Figure 4:
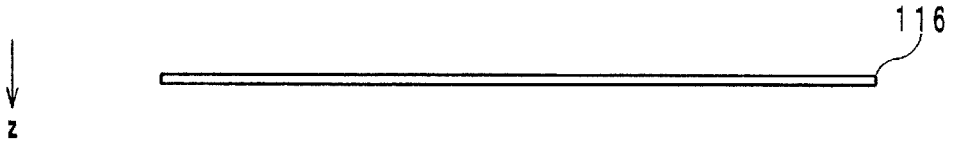
FIG. 4 illustrates a step of manufacturing the electronic component of the embodiment.
Figure 5:
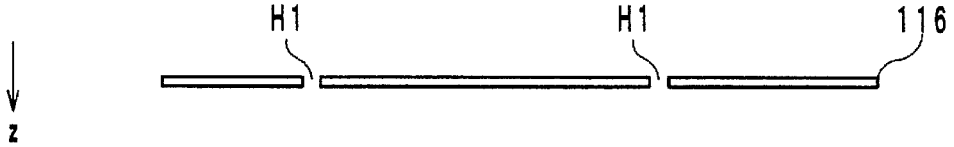
FIG. 5 illustrates a step of manufacturing the electronic component of the embodiment.

First, as illustrated in FIG. 4, a mother insulator substrate 116, which will form a plurality of insulator substrates 16, is prepared. As illustrated in FIG. 5, a plurality of through holes H1 in which the via conductor 39 will be provided are formed in the mother insulator substrate 116 using laser processing for example.

Figure 6:
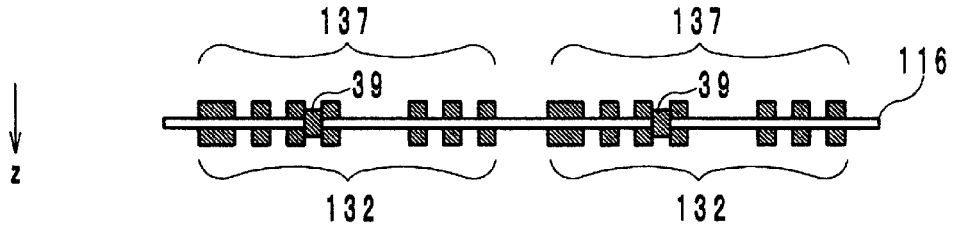
FIG. 6 illustrates a step of manufacturing the electronic component of the embodiment.

Next, the upper surface and the lower surface of the mother insulator substrate 116 in which the plurality of through holes H1 have been formed are subjected to Cu plating. At this time, the insides of the through holes are also plated and a plurality of the via conductors 39 are thus provided. Next, a plurality of conductor patterns 132 and 137 corresponding to the coil conductors 32 and 37 as illustrated in FIG. 6 are formed on the upper surface and lower surface of the mother insulator substrate 116 using photolithography.

Figure 7:
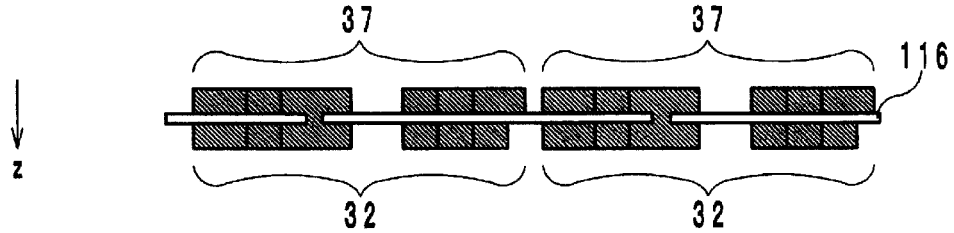
FIG. 7 illustrates a step of manufacturing the electronic component of the embodiment.

After forming the plurality of conductor patterns 132 and 137, Cu plating is again carried out and a plurality of coil conductors 32 and 37 of sufficient thickness are obtained as illustrated in FIG. 7.

Figure 8:
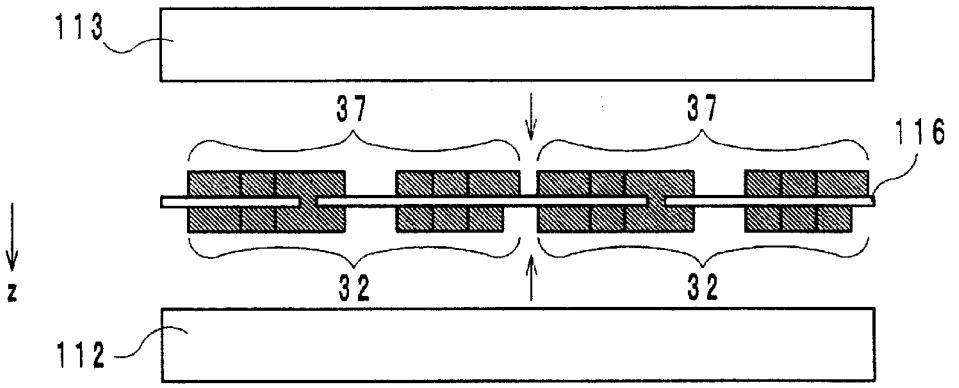
FIG. 8 illustrates a step of manufacturing the electronic component of the embodiment.

The mother insulator substrate 116 on which the plurality of coil conductors 32 and 37 have been formed is sandwiched between insulator sheets 112 and 113, which will form a plurality of insulator layers 12 and 13, from the z-axis direction as illustrated in FIG. 8.

Figure 9:
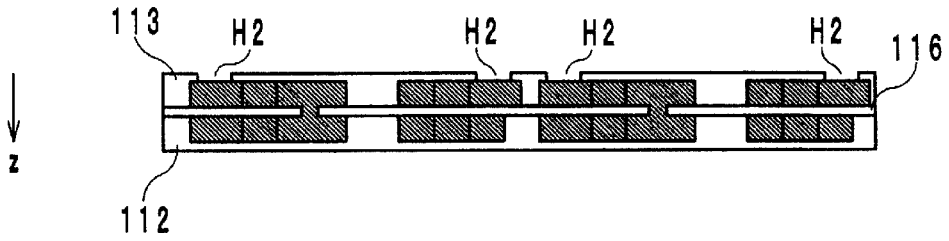
FIG. 9 illustrates a step of manufacturing the electronic component of the embodiment.

Next, as illustrated in FIG. 9, a plurality of through holes H2, in which the via conductors 33 and 38 will be provided, are formed in the insulator sheet 113 by laser processing for example. In addition, a desmear treatment is performed in order to remove smears generated by the formation of the through holes.

Figure 10:
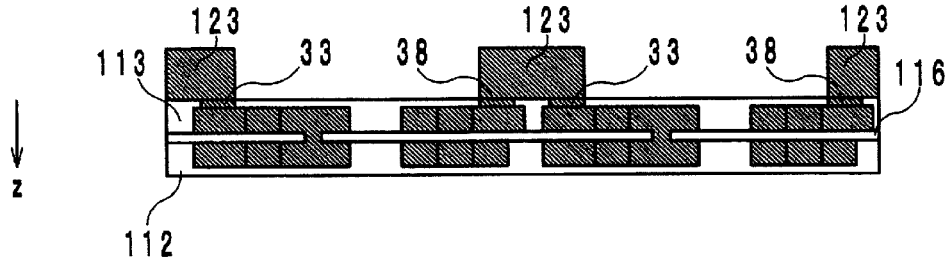
FIG. 10 illustrates a step of manufacturing the electronic component of the embodiment.

Having undergone the desmear treatment, the insulator sheet 113 is then first subjected to electroless Cu plating. The purpose of this electroless plating is to form a seed layer for subsequent Cu electrolytic plating. After formation of the seed layer, the insulator sheet 113 is subjected to Cu electrolytic plating. Thus, as illustrated in FIG. 10, the surface of the insulator sheet 113 and the insides of the through holes are plated and a plurality of the via conductors 33 and 38 are formed.

Next, a plurality of conductor patterns 123 of sufficient thickness and corresponding to the pillar-shaped electrodes 23 and 28 are formed on the insulator sheet 113 by performing photolithography and Cu plating.

Figure 11:
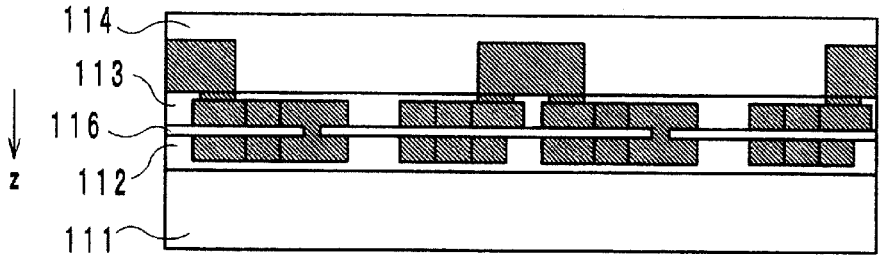
FIG. 11 illustrates a step of manufacturing the electronic component of the embodiment.

As illustrated in FIG. 11, a multilayer body in which the insulator sheet 112, the mother insulator substrate 116 and the insulator sheet 113 are stacked in this order is sandwiched between insulator sheets 111 and 114 corresponding to the insulator layers 11 and 14 in the z-axis direction and then subjected to pressure bonding.

Figure 12:
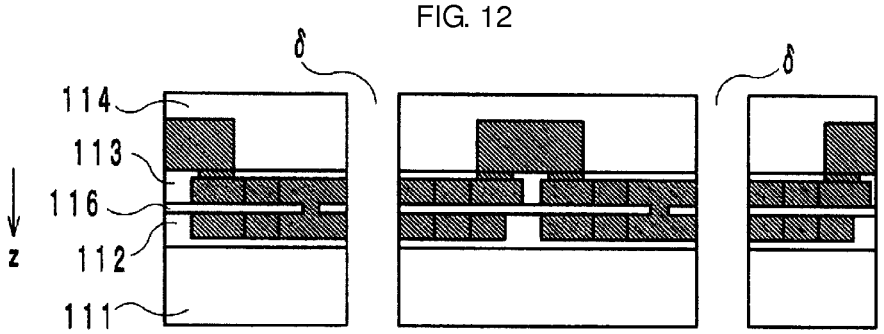
FIG. 12 illustrates a step of manufacturing the electronic component of the embodiment.

Next, as illustrated in FIG. 12, a plurality of through holes δ, which penetrate through the mother insulator substrate 116 and the insulator sheets 111 to 114 in the z-axis direction, are formed using laser processing or the like in order to allow the internal magnetic circuits 18 to be provided. Here, the positions at which the through holes δ are formed are on the inner peripheral sides of the plurality of coil conductors 32 and 37 provided in the mother insulator substrate 116.

Figure 13:
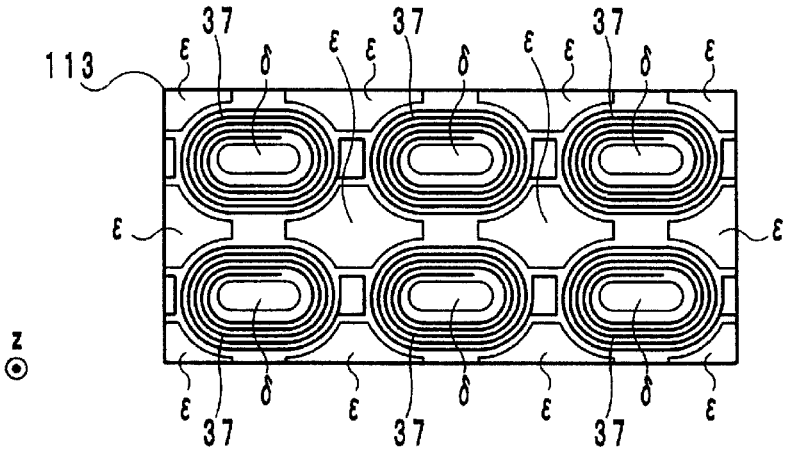
FIG. 13 is a plan view of insulator layers and coils at a manufacturing stage.

As illustrated in FIG. 13, through holes ε, in which the external magnetic circuits 19 will be provided, are formed at the same time as the though holes δ are formed. Here, the positions at which the through holes ε are formed are on the outer peripheral sides of the plurality of coil conductors 32 and 37 provided in the mother insulator substrate 116. The though holes δ and ε may be formed using sandblasting. In addition, for the sake of convenience in illustrating the positions of the through holes ε, FIG. 13 is not a sectional view but rather a plan view illustrating the insulator sheet 113 and the plurality of coil conductors 37.

Figure 14:
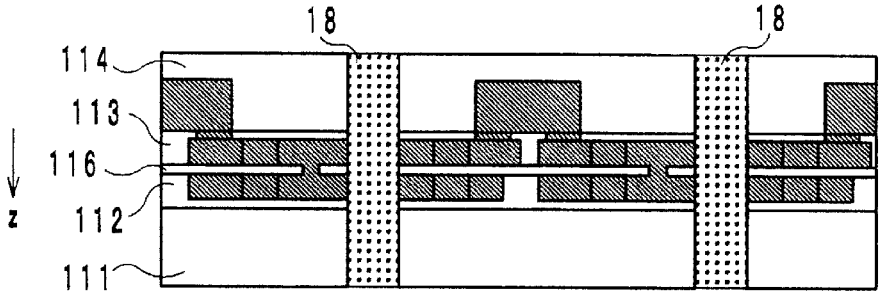
FIG. 14 illustrates a step of manufacturing the electronic component of the embodiment.

After forming the through holes δ and ε, the through holes δ and ε are filled with the isotropic magnetic material using a method such as coating or screen printing. Thus, the internal magnetic circuits 18 are formed as illustrated in FIG. 14. The external magnetic circuits 19 are also formed at this time.

Figure 15:
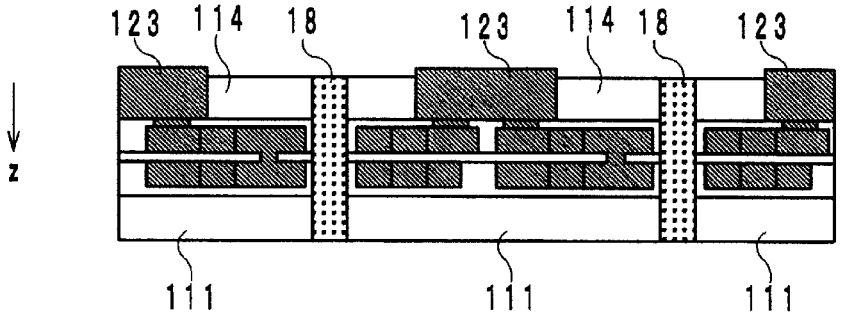
FIG. 15 illustrates a step of manufacturing the electronic component of the embodiment.

Next, the surface of the insulator sheet 114 is subjected to grinding using buff grinding, lap grinding or a grinder. Thus, as illustrated in FIG. 15, the conductor patterns 123 are exposed through the surface of the insulator sheet 114. When subjecting the insulator sheet 114 to grinding processing, the surface of the insulator sheet 111 may also be subjected to grinding to adjust its thickness.

Figure 16:
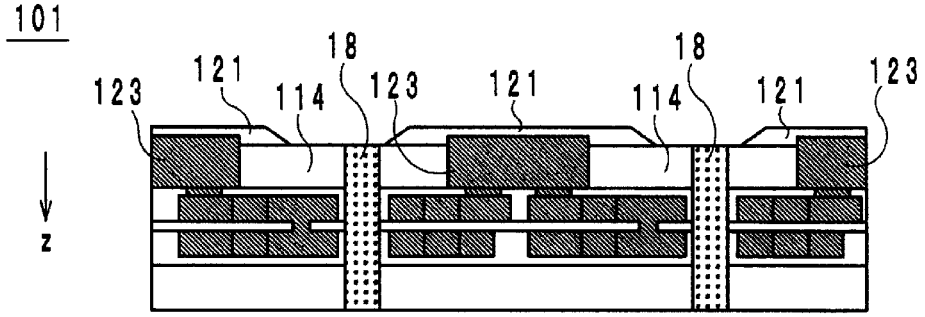
FIG. 16 illustrates a step of manufacturing the electronic component of the embodiment.

A phenol-based resin in which a Ag-coated Cu powder with an average particle diameter of around 100 nm is dispersed is applied onto the conductor patterns 123 exposed through the surface of the resin sheet 114 using screen printing and then dried, and as illustrated in FIG. 16 a plurality of resin electrode patterns 121 corresponding to the bottom surface electrodes 21 and 26 are provided on the surface of the insulator sheet 114. Thus, a mother substrate 101, which is an agglomeration of a plurality of individual electronic components 1, is completed.

Figure 17:
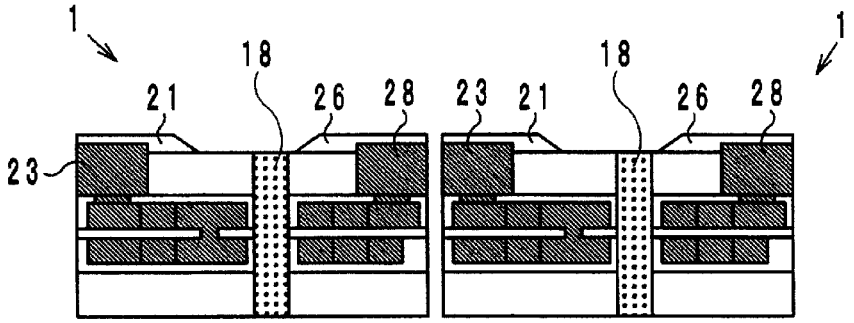
FIG. 17 illustrates a step of manufacturing the electronic component of the embodiment.

Finally, the mother substrate 101 is divided into a plurality of electronic components 1. Specifically, the mother substrate 101 is cut using a dicing saw for example and as illustrated in FIG. 17 the mother substrate 101 is divided into a plurality of electronic components 1. At this time, each conductor pattern 123 is divided into two and the resulting two pieces form the pillar-shaped electrodes 23 and 28. In addition, each resin electrode pattern 121 is also divided and the resulting pieces form the bottom surface electrodes 21 and 26. After dividing the mother substrate 101 into a plurality of electronic components 1, nickel and tin plating may be performed on the surfaces of the outer electrodes 20 and 25 in order to improve the wettability of the outer electrodes 20 and 25.

Effect

Figure 21:
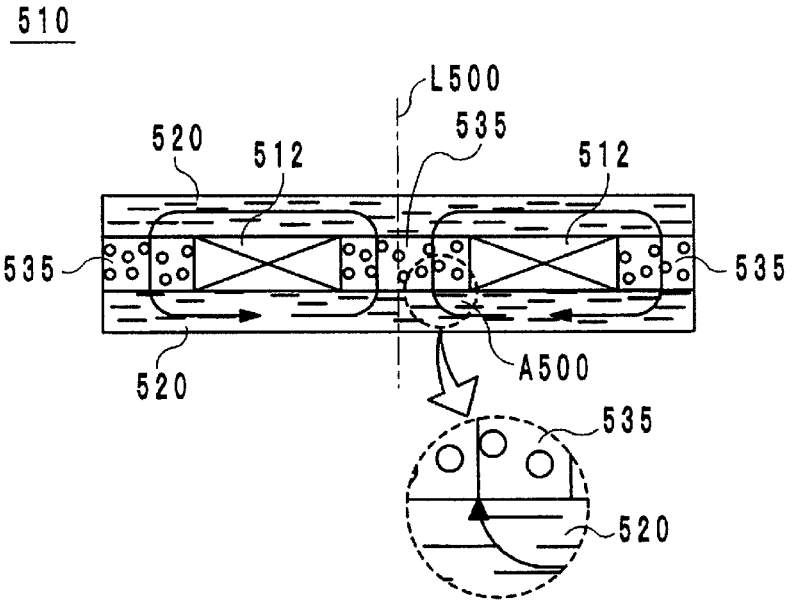
FIG. 21 PRIOR ART
FIG. 21 is a sectional view of an electronic component of the related art.

In the electronic component 1 of the embodiment, magnetic flux generated by the coil 30 is directed toward the isotropic magnetic material without there being a large change in the direction of the magnetic flux from the direction of easy magnetization to the direction of hard magnetization inside the anisotropic magnetic material. As a result, in the electronic component 1, a higher effective magnetic permeability can be obtained compared with the electronic component of the related art. Specifically, magnetic flux generated by the coil 30 draws a loop that advances along an outer peripheral side surface of the coil 30, a lower surface of the coil 30, an inner peripheral side surface of the coil 30 and an upper surface of the coil 30 in this order and then returns to the outer peripheral side surface of the coil 30 as illustrated in FIG. 3. Here, in the case where an anisotropic magnetic material covering a lower surface of the coil 512 and an isotropic magnetic material filling the inner peripheral side surface of the coil 512 are adjacent to each other in a direction parallel to the central axis L500 of the coil 512 as in the electronic component 510 of the related art illustrated in FIG. 21, when the magnetic flux generated by the coil proceeds toward the inner peripheral side surface of the coil from the lower surface of the coil, the magnetic flux is orthogonal to the direction of easy magnetization, that is, parallel to the direction of hard magnetization. In contrast, in the electronic component 1, the anisotropic magnetic material, which covers the lower surface of the coil 30, and the isotropic magnetic material, which fills the inner peripheral side surface of the coil 30, are adjacent to each other in a direction that is orthogonal to a central axis L1 of the coil 30, as illustrated in FIG. 3. In addition, the direction of easy magnetization of the anisotropic magnetic material that covers the lower surface of the coil 30 is orthogonal to the central axis L1 of the coil 30. Consequently, the magnetic flux generated by the coil 30 is directed toward the isotropic magnetic material without there being a large change in the direction of the magnetic flux from the direction of easy magnetization to the direction of hard magnetization inside the anisotropic magnetic material. Therefore, in the electronic component 1, a higher effective magnetic permeability can be obtained compared with the electronic component of the related art. There is not a large change in the direction of the magnetic flux from the direction of easy magnetization to the direction of hard magnetization inside the anisotropic magnetic material when the magnetic flux generated by the coil 30 proceeds toward the upper surface of the coil from the inner peripheral side surface of the coil, proceeds toward the outer peripheral side surface of the coil from the upper surface of the coil and proceeds toward the lower surface of the coil from the outer peripheral side surface of the coil.

The internal magnetic circuit 18 and the external magnetic circuit 19 of the electronic component 1 penetrate through the insulator layers 11 to 14 and the insulator substrate 16 in the z-axis direction. As a result, sliding of the insulator layers 11 to 14 and the insulator substrate 16 in a direction orthogonal to the z axis is suppressed.

First Modification

Figure 18:
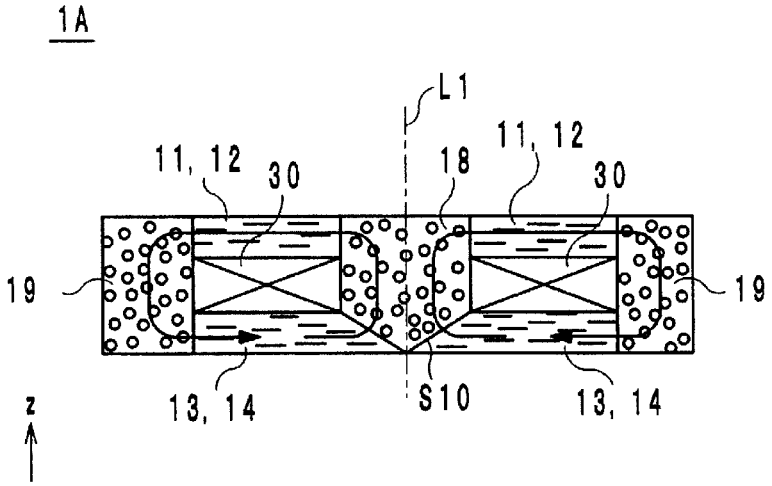
FIG. 18 is a sectional view of an electronic component of a first modification.

A first modification will be described with reference to FIG. 18. An electronic component 1A of the first modification differs from the electronic component 1 of the embodiment in that the internal magnetic circuit 18 of the electronic component 1A does not penetrate all the way through the insulator layer 13 or the insulator layer 14 as illustrated in FIG. 18. In addition, an end portion of the internal magnetic circuit 18 on the negative side in the z-axis direction, that is, a bottom portion of the internal magnetic circuit 18 has a substantially conical shape.

In the thus-structured electronic component 1A, the area of contact between the isotropic magnetic material and the anisotropic magnetic material is larger and therefore the strength of the joining between these two materials is higher than in the electronic component 1.

Second Modification

Figure 19:
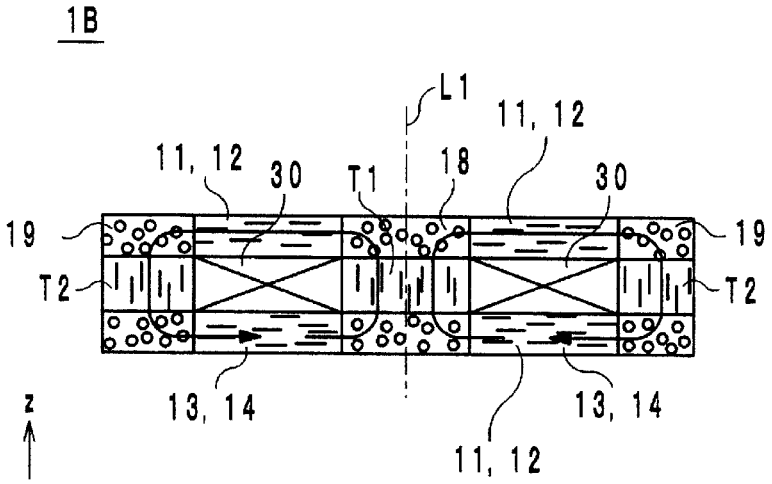
FIG. 19 is a sectional view of an electronic component of a second modification.

A second modification will be described with reference to FIG. 19. An electronic component 1B of the second modification differs from the electronic component 1 of the embodiment in that a portion T1 of the internal magnetic circuit 18 that penetrates through the insulator substrate 16 is formed of the anisotropic magnetic material and a portion T2 of the external magnetic circuit 19 that penetrates through the insulator substrate 16 is formed of the anisotropic magnetic material as illustrated in FIG. 19. In addition, a direction of easy magnetization of the portion T1 of the internal magnetic circuit 18 that penetrates through the insulator substrate 16 and a direction of easy magnetization of the portion T2 of the external magnetic circuit 19 that penetrates through the insulator substrate 16 are parallel to the z-axis direction.

In the thus-structured electronic component 1B, the magnetic flux generated by the coil 30 advances along the direction of easy magnetization of the anisotropic magnetic material when advancing along the outer peripheral side surface of the coil 30, the lower surface of the coil 30, the inner peripheral side surface of the coil 30 and the upper surface of the coil 30 except for in the portions in which the direction of the magnetic flux changes. Therefore, the electronic component 1B has a higher effective magnetic permeability compared with the electronic component 1 in which the magnetic flux generated by the coil 30 advances along the direction of easy magnetization of the anisotropic magnetic material only when advancing along the upper surface and the lower surface of the coil 30.

Other Embodiments

Figure 20:
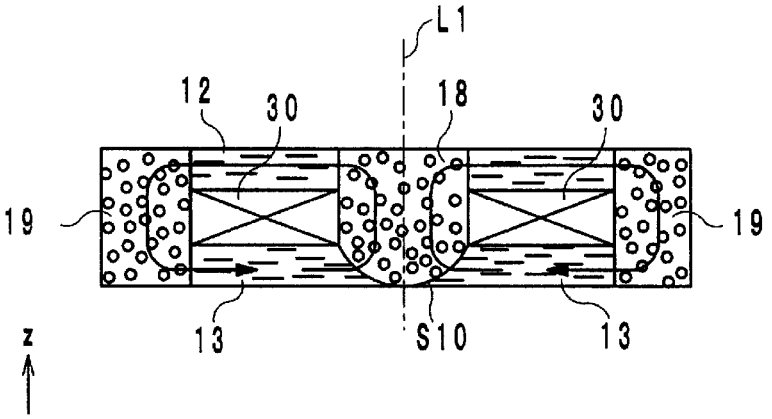
FIG. 20 is a sectional view of an electronic component of another embodiment.

An electronic component according to the present disclosure is not limited to the above-described embodiments and can be modified in various ways within the scope of the gist of the disclosure. For example, as illustrated in FIG. 20, a bottom portion of the internal magnetic circuit 18 in the electronic component 1B may have a substantially hemispherical shape. In addition, the number of turns of the coil and the shapes and positions of the pillar-shaped electrodes and bottom surface electrodes may be appropriately chosen.

As described above, the present disclosure is for use in electronic components that employ an isotropic magnetic material and an anisotropic magnetic material and have a built-in coil and is excellent in that the inductance can be improved.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a body composed of an insulator including an anisotropic magnetic material and an isotropic magnetic material; and a coil located inside the body;

wherein the anisotropic magnetic material is provided so as to cover an end surface, the end surface being a surface of an end portion of the coil in a central axis direction, which is parallel to a central axis of the coil, and being a surface of a conductor portion of the coil, the isotropic magnetic material is adjacent to the anisotropic magnetic material in an orthogonal direction, which is orthogonal to the central axis direction, and a direction of easy magnetization of a portion of the anisotropic magnetic material that covers the end surface in a vicinity of an interface between the anisotropic magnetic material and the isotropic magnetic material coincides with the orthogonal direction.

2. The electronic component according to claim 1, wherein the isotropic magnetic material extends from a surface of an end portion of the body on one side in the central axis direction to a surface of an end portion of the body on another side in the central axis direction, and an end portion of the isotropic magnetic material on the other side is substantially shaped like a cone or a hemisphere.

3. The electronic component according to claim 1, wherein the anisotropic magnetic material is provided so as to be sandwiched by the isotropic magnetic material in the central axis direction, and a direction of easy magnetization of a portion of the anisotropic magnetic material provided so as to be sandwiched by the isotropic magnetic material in the central axis direction coincides with the central axis direction.

4. The electronic component according to claim 1, wherein a direction of a magnetic flux generated by the coil at an interface between the anisotropic magnetic material and the isotropic magnetic material substantially coincides with the orthogonal direction.

5. An electronic component comprising:

a body composed of an insulator including an anisotropic magnetic material and an isotropic magnetic material; and a coil located inside the body;

wherein the anisotropic magnetic material is provided so as to cover an end surface, the end surface being a surface of an end portion of the coil in a central axis direction, which is parallel to a central axis of the coil, and being a surface of a conductor portion of the coil, the isotropic magnetic material is adjacent to the anisotropic magnetic material in an orthogonal direction, which is orthogonal to the central axis direction, and a direction of easy magnetization of a portion of the anisotropic magnetic material that covers the end surface in a vicinity of an interface between the anisotropic magnetic material and the isotropic magnetic material coincides with the orthogonal direction, wherein the isotropic magnetic material extends from a surface of an end portion of the body on one side in the central axis direction to a surface of an end portion of the body on another side in the central axis direction.

* * * * *